US011745968B1

(12) United States Patent
Tsukada et al.

(10) Patent No.: US 11,745,968 B1
(45) Date of Patent: Sep. 5, 2023

(54) SHEET FEED SHAFT, MANUFACTURING DEVICE FOR THE SAME, AND METHOD FOR MANUFACTURING THE SAME

(71) Applicant: TECSIA MACHINERY CORPORATION, Tokyo (JP)

(72) Inventors: Eiji Tsukada, Tokyo (JP); Masahide Tsukada, Tokyo (JP)

(73) Assignee: TECSIA MACHINERY CORPORATION, Tokyo (JP)

( * ) Notice: Subject to any disclaimer, the term of this patent is extended or adjusted under 35 U.S.C. 154(b) by 0 days.

(21) Appl. No.: 18/070,232

(22) Filed: Nov. 28, 2022

(30) Foreign Application Priority Data

May 31, 2022 (JP) ..... 2022-088478

(51) Int. Cl.
*B65H 5/06* (2006.01)

(52) U.S. Cl.
CPC ..... *B65H 5/06* (2013.01); *B65H 2404/1141* (2013.01); *B65H 2404/181* (2013.01)

(58) Field of Classification Search
CPC ..... B65H 5/06
See application file for complete search history.

(56) References Cited

U.S. PATENT DOCUMENTS 8,454,416 B1 * 6/2013 Estes ..... A01F 12/24 460/107
8,690,652 B1 * 4/2014 Estes ..... A01F 12/24 460/107

FOREIGN PATENT DOCUMENTS

| | | | | |
|---|---|---|---|---|
| CN | 103569698 | A | * | 2/2014 |
| JP | S6475335 | A | * | 3/1989 |
| JP | H10109777 | A | * | 4/1998 |
| JP | H1120962 | A | * | 1/1999 |
| JP | 2003063680 | A | * | 3/2003 |
| JP | 2004001925 | A | * | 1/2004 |
| JP | 2005001865 | A | * | 1/2005 |
| JP | 2011-057427 | A | | 3/2011 |
| JP | 2011057427 | A | * | 3/2011 |

* cited by examiner

*Primary Examiner* — Jacob J Cigna

(74) *Attorney, Agent, or Firm* — Thomas W. Cole; Calderon Safran & Cole P.C.

(57) ABSTRACT

A sheet feed shaft includes a metallic rod, and a plurality of projections formed by plastic working to rise in a circumferential direction at a plurality of regions in the circumferential direction and in an axial direction on a peripherical surface of the metallic rod. α and β satisfy following relations (a) and (b) in a range that the α is not less than 300 and not more than 110°, $$\beta_0=-0.002\alpha^2+0.854\alpha-3.72, \quad (a)$$

$$0.85\times\beta_0\leq\beta\leq1.15\beta_0, \quad (b)$$

where an apex angle of the projections viewed from the circumferential direction of the metallic rod is defined as α, and an apex angle of the projections viewed from an axial direction of the metallic rod is defined as β.

1 Claim, 15 Drawing Sheets

3A FIRST PROJECTION GROUP
3B SECOND PROJECTION GROUP

*FIG. 13*

122e

| DIVISION OF PROJECTION | LEVEL | $\alpha$ | $\beta$ | $\mu 1$ | $\mu 2$ | $\mu 3$ |
|---|---|---|---|---|---|---|
| LARGE PROJECTION | -5 | 106.1 | 64.2 | 0.198 | 0.145 | 0.186 |
| | -4 | 100.7 | 62.1 | 0.192 | 0.132 | 0.169 |
| | -3 | 95.5 | 59.7 | 0.187 | 0.120 | 0.154 |
| | -2 | 88.8 | 56.6 | 0.183 | 0.106 | 0.137 |
| MIDDLE PROJECTION | -1 | 81.9 | 53.0 | 0.178 | 0.093 | 0.122 |
| | 0 | 73.2 | 48.2 | 0.173 | 0.078 | 0.104 |
| | +1 | 64.0 | 42.7 | 0.169 | 0.064 | 0.087 |
| SMALL PROJECTION | +2 | 53.8 | 36.3 | 0.164 | 0.051 | 0.071 |
| | +3 | 42.9 | 29.1 | 0.161 | 0.039 | 0.055 |
| | +4 | 30.7 | 20.8 | 0.155 | 0.027 | 0.038 |

SHEET FEED SHAFT, MANUFACTURING DEVICE FOR THE SAME, AND METHOD FOR MANUFACTURING THE SAME

CROSS-REFERENCES TO RELATED APPLICATIONS

The present patent application claims the priority of Japanese patent application No. 2022/088478 filed on May 31, 2022, and the entire contents of Japanese patent application No. 2022/088478 are hereby incorporated by reference.

TECHNICAL FIELD

The present invention relates to a sheet feed shaft, a manufacturing device for the same, and a method for manufacturing the same.

BACKGROUND ART

For paper feeding in a printer for an office machine etc., a sheet feed shaft sandwiching a sheet between a feed roller, which forms plural projections rising in a circumferential direction on a circumferential surface of metallic rod opposite to the feed roller by plastic working is used. As a projection shape, for example, the projection is formed to have an apex angle α of cutting surface of the projection of 30° to 120°, and plural projections having the rising directions opposite each other are arranged along the circumferential direction and the axial direction (See e.g., Patent Literature 1).

CITATION LIST

Patent Literature

Patent Literature 1: JP 2011/057427 A

SUMMARY OF INVENTION

In order to accurately convey a wide variety of sheet materials including a paper such as a plain paper and a photo paper and a plastic film such as a nylon film and a polyethylene film, it is necessary to clearly define an apex angle β in the projection thickness direction. For example, the load applied to the sheet may differ between the leading edge and the trailing edge of the sheet. If the apex angle β in the thickness direction of the protrusion is too large, the different load applied to the sheet causes the protrusion to bite into the sheet material. This causes a difference in the feed amount of the sheet material. In particular, in recent color printers, this paper feeding deviation (feeding unevenness) is a problem, and it is desired that the feeding unevenness be not more than 10 μm.

In order to solve this problem, if the apex angle β in the thickness direction of the projection is set small, fluctuations in the feeding amount of the sheet material can be improved. On the other hand, if the apex angle β in the projection thickness direction is too small, there is a problem that the projections deeply bite into the sheet material, resulting in greater damage to the sheet material.

On the other hand, regarding the shape of the projection in the thickness direction, the apex angle β in the projection thickness direction is appropriately set based on the operator's experience and intuition. Since the machine was adjusted based on the operator's experience and intuition, there were many combinations of sheet materials and roller diameters, and especially in the case of inexperienced combinations, there is a problem that it takes time to adjust the β value relative to the α value.

It is an object of the present invention to provide a sheet feed shaft that is capable of accurately conveying a desired sheet material by properly forming a projection shape suitable for various sheet materials, a manufacturing apparatus thereof and a manufacturing method thereof.

An aspect of the invention provides a sheet feed shaft, a manufacturing apparatus thereof and a manufacturing method thereof as mentioned below.

(1) A sheet feed shaft, comprising:

a metallic rod; and a plurality of projections formed by plastic working to rise in a circumferential direction at a plurality of regions in the circumferential direction and in an axial direction on a peripherical surface of the metallic rod, wherein α and β satisfy following relations (a) and (b) in a range that the a is not less than 300 and not more than 110°, $$\beta_0=-0.002\alpha^2+0.854\alpha-3.72, \quad \text{(a)}$$

$$0.85\times\beta_0\leq\beta\leq1.15\beta_0, \quad \text{(b)}$$

where an apex angle of the projections viewed from the circumferential direction of the metallic rod is defined as α, and an apex angle of the projections viewed from an axial direction of the metallic rod is defined as β.

(2) A manufacturing device for a sheet feed shaft, comprising:

a support stand to support a metallic rod;

a holding member to be driven in reciprocate directions opposite to the support stand by a processing device;

a perforating member to be attached to the holding member to form a projection on a peripherical surface of the metallic rod by plastic working to rise in a circumferential direction; and a controller to calculate β from a relational expression of α and β based on an information according to input α, obtain a control information to form the projection having target α and β, and control the processing device to form the projection having the target α and β at a plurality of positions of peripherical surface of the metallic rod, wherein an apex angle of the projection viewed from a circumferential direction of the metallic rod is defined as α, an apex angle of the projection viewed from an axial direction of the metallic rod is defined as β.

(3) The manufacturing device for the sheet feed shaft according to (2), wherein the control information comprises a distance from a center line through a center of the metallic rod to a pathway that the perforating member reciprocates, and a cutting stroke of the perforating member to the peripherical surface of the metallic rod.

(4) A method for manufacturing a sheet feed shaft comprising a metallic rod and a projection on a peripherical surface of the metallic rod to rise in a circumferential direction by plastic working, the method comprising:

calculating β from a relational expression of α and β based on an information according to input α, and obtaining a control information to form the projection having target α and β, and forming the projection having the target α and β at a plurality of positions of peripherical surface of the metallic rod, wherein an apex angle of the projection viewed from a circumferential direction of the metallic rod is defined as α, an apex angle of the projection viewed from an axial direction of the metallic rod is defined as β.

ADVANTAGEOUS EFFECTS OF INVENTION

According to an embodiment of the invention, a sheet feed shaft can be provided that is capable of accurately conveying a desired sheet material by properly forming a projection shape suitable for various sheet materials, as well as a manufacturing apparatus thereof and a manufacturing method thereof.

BRIEF DESCRIPTION OF DRAWINGS

FIG. 13 is a table showing an example of a-D table in the variation 1.

DESCRIPTION OF EMBODIMENTS

The embodiments according to the present invention will be explained with referred to drawings. In the meantime, elements having substantially same functions will be followed by the same numeral and repeated explanation will be omitted.

Summary of the Embodiments

A manufacturing device according to the embodiments of the invention includes:

a support stand to support a metallic rod;

a holding member to be driven in reciprocate directions opposite to the support stand by a processing device;

a perforating member to be attached to the holding member to form a projection on a peripherical surface of the metallic rod by plastic working to rise in a circumferential direction; and a controller to calculate β from a relational expression of α and β based on an information according to input α, obtain a control information to form the projection having target α and β, and control the processing device to form the projection having the target α and β at a plurality of positions of peripherical surface of the metallic rod, wherein an apex angle of the projection viewed from a circumferential direction of the metallic rod is defined as α, an apex angle of the projection viewed from an axial direction of the metallic rod is defined as β.

Input also includes selection. For example, one α selected from plural α's may be inputted. Information according to the entered α includes not only itself, but also information that indirectly indicates α. For example, α may be a value information steeply indicating value of α, or a predetermined sheet type or predetermined sheet identification information corresponding to α instead of α.

Embodiments (Construction of Sheet Feed Device)

Figure 1:
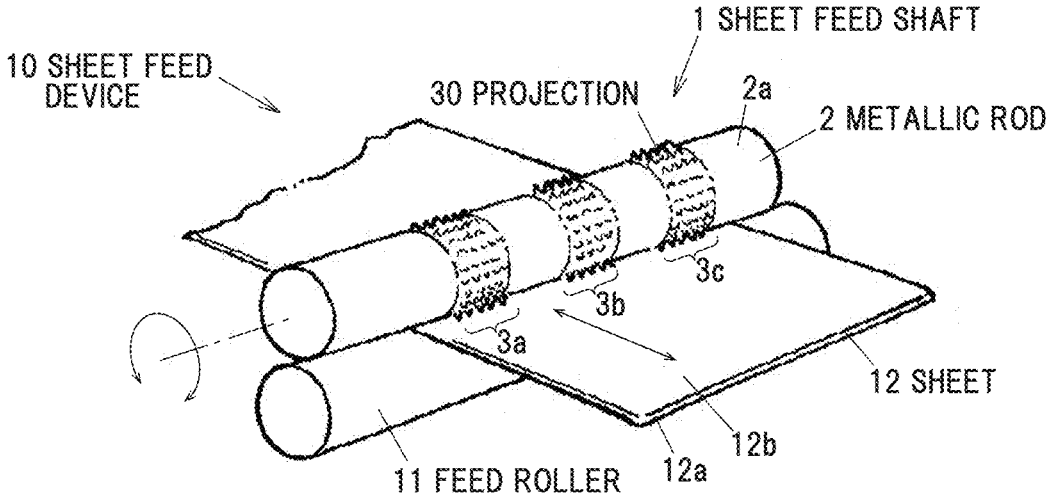
FIG. 1 is a perspective view showing a main part of sheet feeding device including a sheet feed shaft according to the embodiment of the present invention.

FIG. 1 is a perspective view showing a main part of sheet feeding device including a sheet feed shaft according to the embodiment of the present invention. The sheet feed device 10 includes a hard rubber feed roller 11, a metallic sheet feed shaft 1 including plural projections 30, which are arranged to be opposite to the feed roller 11 with sandwiching sheet 12, and a driving part feeding the sheet 12 in a reciprocate directions shown in arrow by driving and reversing the sheet feed shaft 1 by a motor (not shown).

The sheet feed device 10 can surely grip and feed the sheet 12 with high feed accuracy by contacting the feed roller 11 with a printed surface 12*a* side of the sheet 12 and contacting the projections 30 of the sheet feed shaft 1 with a back surface 12*b* opposed to the printed surface 12*a*. The projections include preferable range of apex angle α viewed from a circumferential direction and apex angle β viewed from an axial direction corresponding to characteristics of the sheet 12. The projections 30 including the apex angles α and β in the preferable range can be manufactured by a manufacturing device according to the embodiment described below. The sheet feed device 10 can be used fora printer or a cutting machine such as a sublimation type or inkjet type.

(Composition of Sheet)

The sheet 12 includes various characteristics. The sheet 12 can be classified to plural type corresponding to the index indicating resistance to bite by the projections 30 (e.g., strength in a thickness direction or hardness). For example, the sheet 12 can be classified to type 1 sheet having relatively high strength in the thickness direction, type 2 sheet having relatively middle strength in the thickness direction, and type 3 sheet having relatively low strength in the thickness direction.

The expression of the above index may differ depending on the manufacturer of the sheet 12, and the sheet type may differ even if the material is the same. For example, it may be classified using the following impact strength kg·cm as an index. In the following classification, the case of a plastic film as a sheet material will be shown, but the paper can also be classified in the same way.

Type 1 sheet (hard)

Nylon (PA): 17 kg·cm

For example, it is used for clothing and outdoor banner advertisements.

Type 2 sheet (slightly hard)

Polyethylene: 7-11 kg·cm

For example, it is used as a media mount for cutting machines.

(PET): 7-9 kg·cm

For example, it is used on the back side of photo printer media.

Type 3 sheet (soft)

Polypropylene (PP): 5-7 kg·cm

For example, it is used on the back side of photo printer media.

The number of categories is not limited to the above three. The abovementioned type 1 sheet, type 2 sheet and type 3 sheet are examples of sheet type or sheet identification information.

(Construction of Sheet Feed Shaft)

Figure 2:
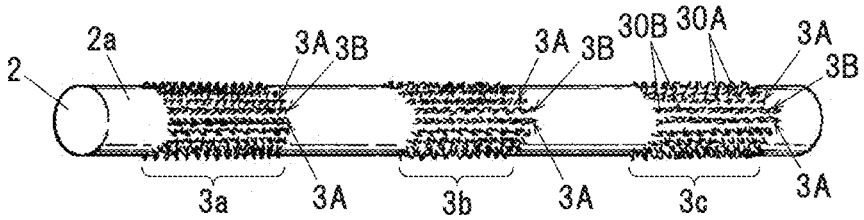
FIG. 2 is a perspective view showing the sheet feed shaft in FIG. 1.
Figure 3:
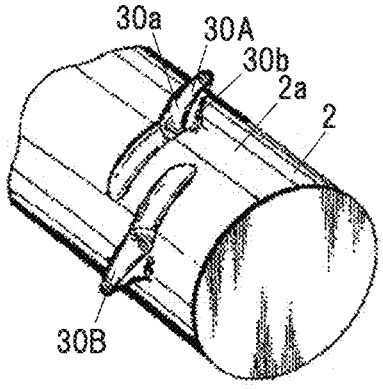
FIG. 3 is a perspective view schematically showing projections in FIG. 2 with enlarging.
Figure 4:
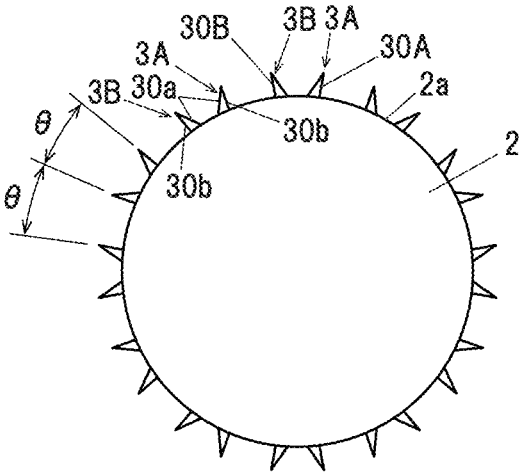
FIG. 4 is a side view schematically showing the sheet feed shaft viewed from an axial direction.

FIG. 2 is a perspective view showing the sheet feed shaft 1 in FIG. 1. FIG. 3 is a perspective view schematically showing projections 30 in FIG. 2 with enlarging. FIG. 4 is a side view schematically showing the sheet feed shaft 1 viewed from an axial direction.

As shown in FIG. 2, the sheet feed shaft 1 includes a metallic rod 2 formed of metallic materials having plastic such as steel and copper, and plural projections 30 formed on a peripherical surface 2*a* of the metallic rod 2 to rise in a circumferential direction by plastic working. For example, the plural projections 30 are formed on the peripherical surface 2*a* at three regions 3*a*, 3*b*. 3*c* in a longitudinal direction of the metallic rod 2, which are inside in the width of sheet 12.

The plural projections 30 include one pair of projections 30A and 30B that are opposite each other in the rising directions by plastic working by one pair of perforating members 52A and 52B described below (see e.g., FIG. 6) having intervals smaller than a diameter of the metallic rod 2 as shown in FIG. 3. As shown in FIG. 2, the projections 30A rising in one direction configure a first projection group 3A by forming in line along an axial direction of the peripherical surface 2*a*, and the projections 30B rising in the other direction configure a second projection group 3B by forming in line along the axial direction of the peripherical surface 2*a*. The first projection group 3A and the second projection group 3B are arranged at plural parts along the circumferential direction and the axial direction of the metallic rod 2.

As shown in FIG. 4, the first projection group 3A and the second projection group 3B are formed to set angle between tip ends in the circumferential direction as an equal angle interval θ (in case shown in FIG. 11A, a circumferential direction pitch Z/2), and arranged in line along the axial direction. In the meantime, FIG. 4 emphasizes the first projection group 3A and the second projection group 3B and shows in a large figure. Numbers of the first projection group 3A and the second projection group 3B are not limited to the number shown in FIG. 4. It is possible to surely grip the sheet 12 and feed the sheet 12 in the reciprocate directions with feed accuracy by forming one pair of the projections 30A and 30B that are opposite to each other in the rising directions.

The sheet feed device 10 may feed the sheet 12 in the front direction. In this case, the sheet feed device 10 may include the first projection group 3A or the second projection group 3B. When the first projection group 3A is used, it is possible to prevent from damaging the sheet 12 by turning a cutting surface 30*a* side to a rotational direction. When the second projection group 3B is used, it is possible to surely grip the sheet 12 by turning the rising surface 30*b* side to a rotational direction.

(Construction of Manufacturing Device)

Figure 5:
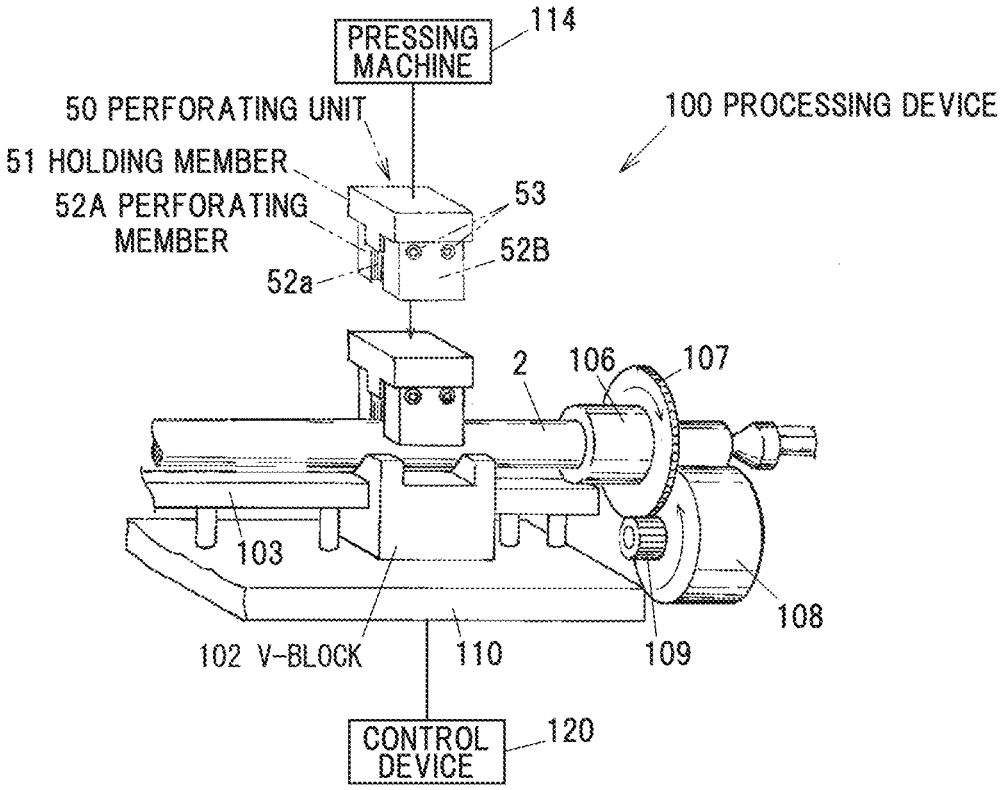
FIG. 5 is a perspective view showing an example of manufacturing device for the sheet feed shaft.

FIG. 5 is a perspective view showing an example of manufacturing device for the sheet feed shaft 1. The manufacturing device includes a processing device to process the metallic rod 2 that is a process target, and a control device 120 to control the processing device 100.

(Construction of Processing Device)

The processing device 100 includes a base 101, a v-block 102 that is an example of support stand arranged on the base 101, a lifter 103 that pushes up the metallic rod 2 supported on the v-block 102 that is a process target from above the v-block 102, a holding bush 106 fixed on one end of the metallic rod 2, a layout gear 107 collectively attached to the holding bush 106, and a stepping motor 108 that drives a driving gear 109 engaged to the layout gear 107.

Further, the processing device 100 includes a perforating unit 50. the perforating unit 50 drives in a reciprocating direction opposite to the v-block 102 by a pressing machine 114 by controlled by the control device 120. The perforating unit 50 includes a holding member 51, one pair of perforating members 52A, 52B fixed to the holding member 51 by fasteners 53 such as bolt or thread.

(Construction of Perforating Unit)

Figure 6:
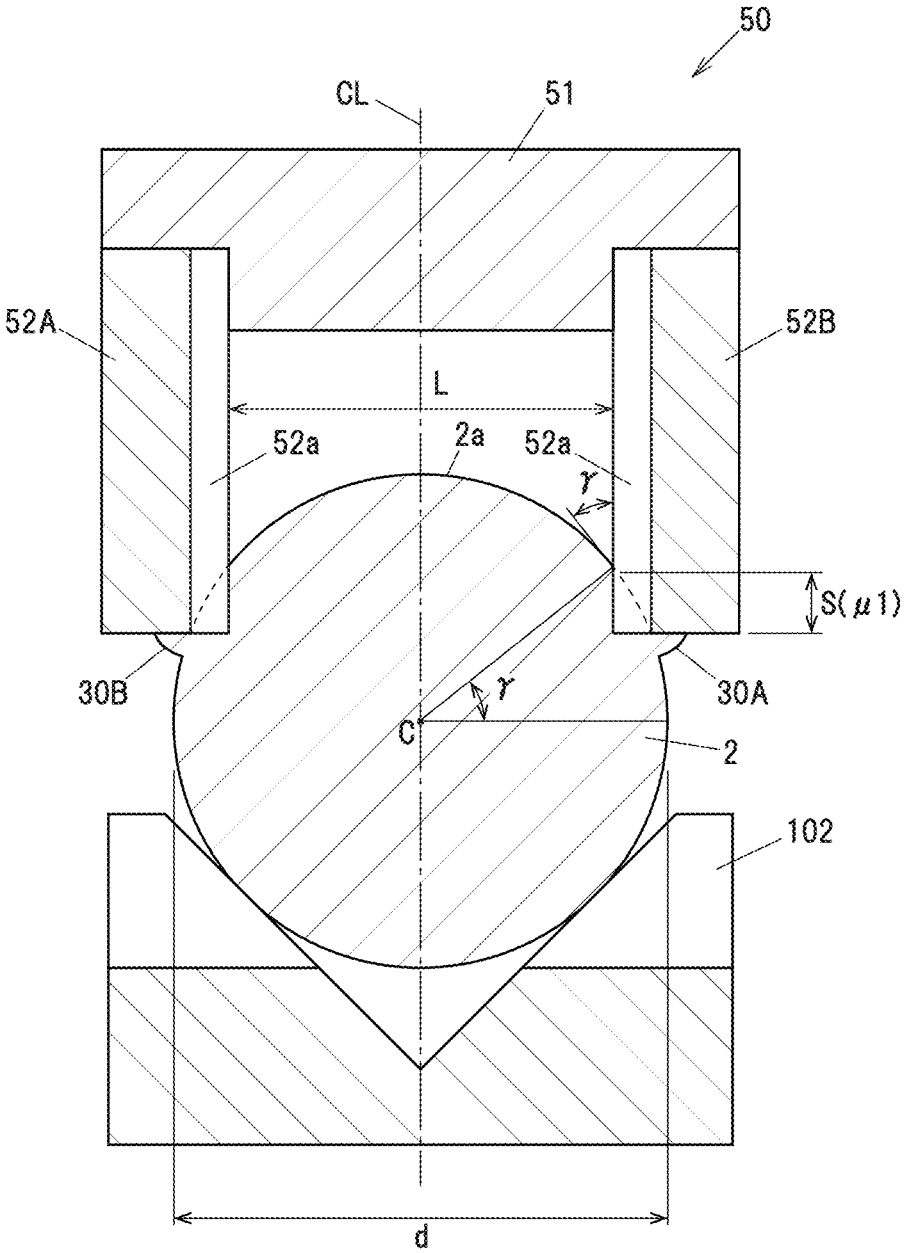
FIG. 6 is a cross-sectional view showing a perforating unit of FIG. 7 cut along the A-A line.
Figure 7:
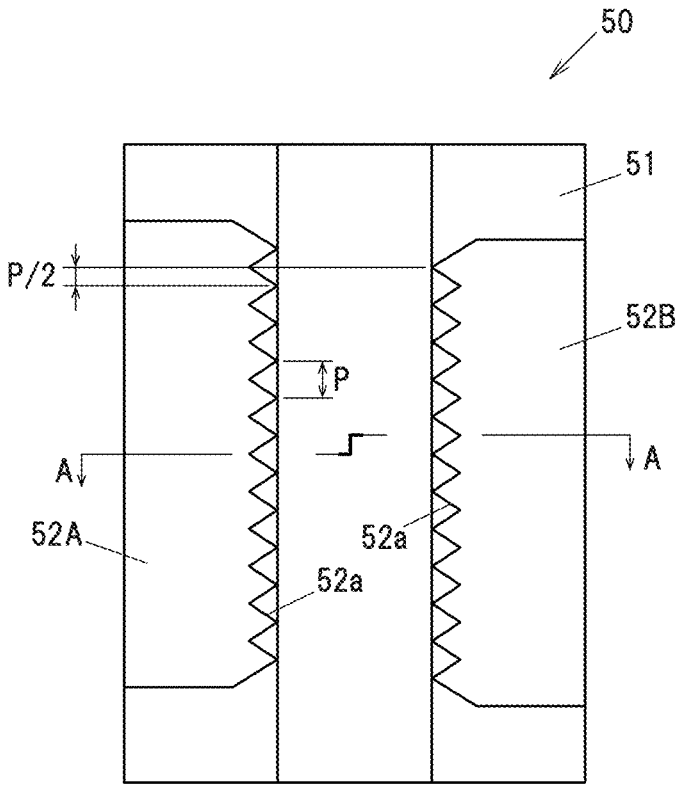
FIG. 7 is a diagram showing an example of the perforating unit viewed from a metallic rod side.

FIG. 6 is a cross-sectional view showing the perforating unit 50 of FIG. 7 cut along the A-A line. The perforating unit 50 includes the vertically movably supported holding member 51, one pair of the perforating members 52A, 52B having perforating edges 52*a* of which tip ends are formed in an acute angle (e.g., 60°).

In FIG. 6, term "d" indicates a diameter of the metallic rod 2. The term "S" indicates a cutting depth of the perforating edge 52*a* (the cutting stroke of the perforating unit 50. The term "γ" edges an incident angle of the perforating edge 52*a* against the peripherical surface 2*a* of the metallic rod 2. The term "μ1" indicates length in the circumferential direction of a cutting concave part 31 described below (see e.g., FIG. 8).

A length from a center line CL of the metallic rod 2 through the center C to a pathway that the perforating members 52A and 52B reciprocates is defined as L/2.

The perforating unit 50 is configured to easily adjust the length L between the perforating members 52A and 52B. As the method for adjusting the length L, e.g., the method by adjusting a number of thin plate intersected between the holding member 51 and the perforating member 52A and 52B, or the method to relatively move the perforating members 52A and 52B by rotation of threading member of which a right-handed thread is formed at one side and a left-handed thread is formed at the other side may be used.

In addition, as shown in FIG. 7 described below, although plural perforating edges 52*a* continue in the axial direction of the metallic rod 2, the perforating edge 52*a* may be single. Further, when manufacturing the sheet feed shaft 1 having only one of the first projection group 3A and the second projection group 3B, only one of the perforating members from one pair of the perforating member 52A and 52B may be used.

FIG. 7 is a diagram showing an example of the perforating unit 50 viewed from a metallic rod 2 side. In the perforating members 52A and 52B, plural perforating edges 52*a* is formed on one side surface respectively opposite to each other in a longitudinal direction (a direction parallel to the center line CL shown in FIG. 6). Further, the perforating members 52A, 52B are opposite each other with keeping the length L, and each opposite perforating edges 52*a* is arranged to shift the position in the axial direction at a half of one pitch (P/2) of cone P. Hereby it is possible to increase density of the projections 30 compared to the case that does not shift the positions of the perforating members 52A and 52B.

(Shape of Projections and Surrounds)

Figure 8A:
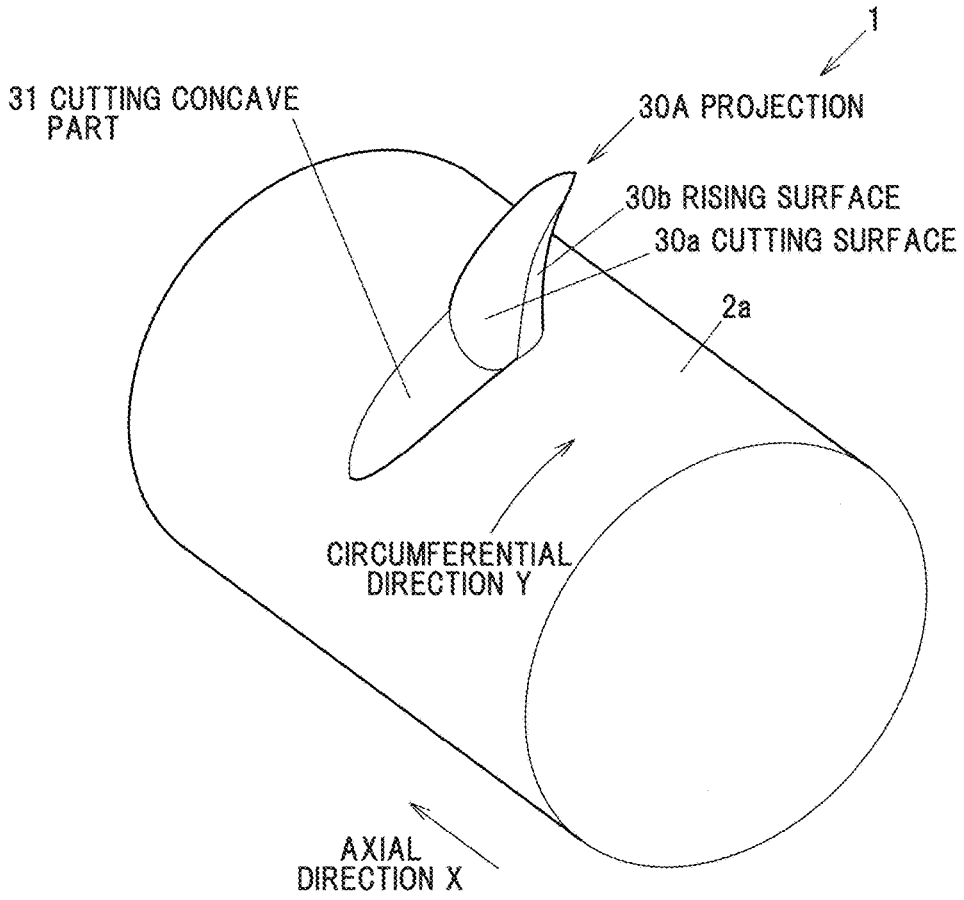
FIG. 8A is a perspective view showing a projection and surrounds with enlarging.
Figure 8B:
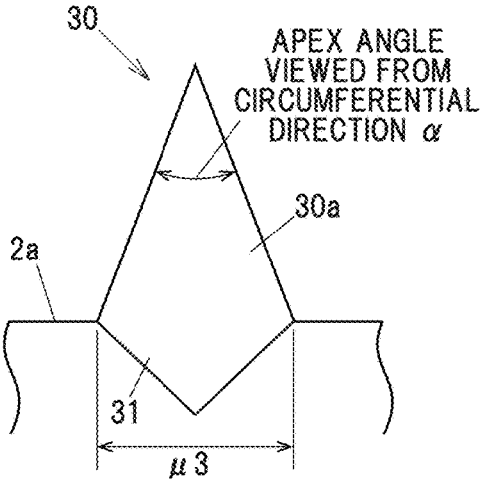
FIG. 8B is a schematic view showing an example of the projection viewed from a circumferential direction.
Figure 8C:
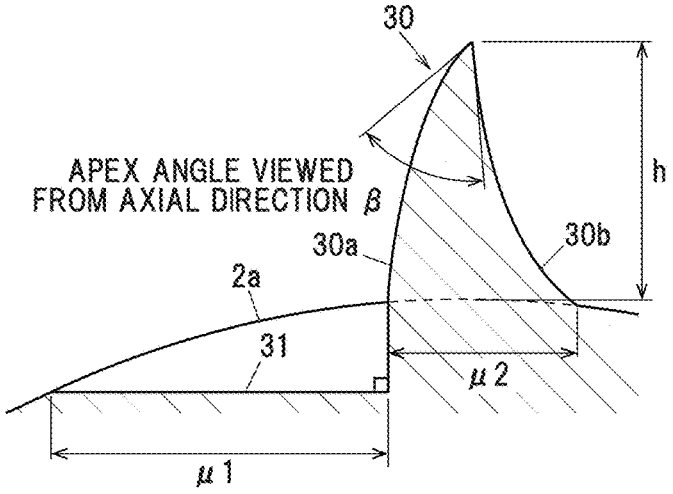
FIG. 8C is a schematic view showing a cross-section around the projection viewed from an axial direction.

FIG. 8A is a perspective view showing a projection and surrounds with enlarging. FIG. 8B is a schematic view showing an example of the projection viewed from a circumferential direction. FIG. 8C is a schematic view showing a cross-section around the projection viewed from an axial direction.

Figure 9:
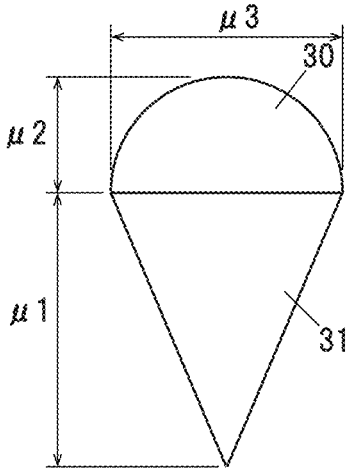
FIG. 9 is a plan view showing the projection and surrounds shown in FIGS. 8A to 8C.

As shown in FIGS. 8A to 8C, the cutting concave part 31 is formed on the peripherical surface 2*a* of the metallic rod 2 by the perforating edge 52*a*. Thus, the cutting surface 30*a* is exposed and rolled back from the peripherical surface 2*a*. The projection 30 is formed such that a rising surface 30*b* opposite to the cutting surface 30*a* rises at approximately 90° from the peripherical surface 2*a* The projection 30 has the apex angle α viewed from the circumferential direction Y of the metallic rod 2, the apex angle β viewed from the axial direction X of the metallic rod 2, and height h. In addition, as shown in FIGS. 8B, 8C, and 9, it will be explained with defining length of bottom surface of the cutting concave part 31 in the circumferential direction Y as μ1, length of the projection 30 in the circumferential direction Y as μ2, and length of the projection 30 in the axial direction X as μ3.

(Preferable Range of the Apex Angle of Projection)

Preferable range of the apex angles α, β of the projection 30 are found by the experiment by the inventor. The experiment is performed by manufacturing the projections 30 having variable apex angles α, β, feeding the sheet 12 with loading tension corresponding to feed load actually applied to the sheet 12, and measuring pitch of traces of the projection 30 formed on the back surface 12*b* of the sheet 12.

The preferable range (here is referred to as available range) of the apex angles α and β is found by measuring the pitch of trace of the projection 30 with high tension as L1 and the pitch of trace of the projection 30 with low tension as L2 corresponding to actual change of tension, and calculate difference ΔL between the both pitches L1 and L2 (i.e., L1−L2), and considering the projection satisfying the difference ΔL in a tolerance according to feeding unevenness (e.g., not less than 10 μm), resistance of the projection 30, or damage for the sheet 12.

From the experimental result shown in Table 1 described below, it was found that the apex angles α and β are within the available range by satisfying α and β in the relation of formulas (a) and (b) when α is not less than 30° and not more than 110°. Herein, the formula (a) is an example of relational expression defining α and $\beta_0$ as α increases, $\beta_0$ increases.

$$\beta_0=-0.002\alpha^2+0.854\alpha-3.72 \quad (a)$$

$$0.85\beta_0\leq\beta\leq1.15\beta_0 \quad (b)$$

Meanwhile, the formula (a) replaces β in the formula (1) described below into $\beta_0$ and the formula (b) defines the lower limit of β ($0.85\beta_0$) and the upper limit of β ($1.15\beta_0$) to define the available range of β.

If β is higher than the maximum value (e.g., $1.15\beta_0$) to α, bite volume to the sheet 12 changes and thus feed value of the sheet 12 may cause difference between the front end and rear end when the load against paper changes at the front end and the rear end of the sheet 12 (e.g., when feeding the sheet 12 with contacting the other sheet 12). If β is lower than the minimum value (e.g., $0.85\beta_0$), the difference in feed value of the sheet 12 can be improved. However, the problem according to the durability may cause or the damage to the sheet 12 may increase by deeply biting the projection 30 into the sheet 12.

(Construction of Control Device)

Figure 10:
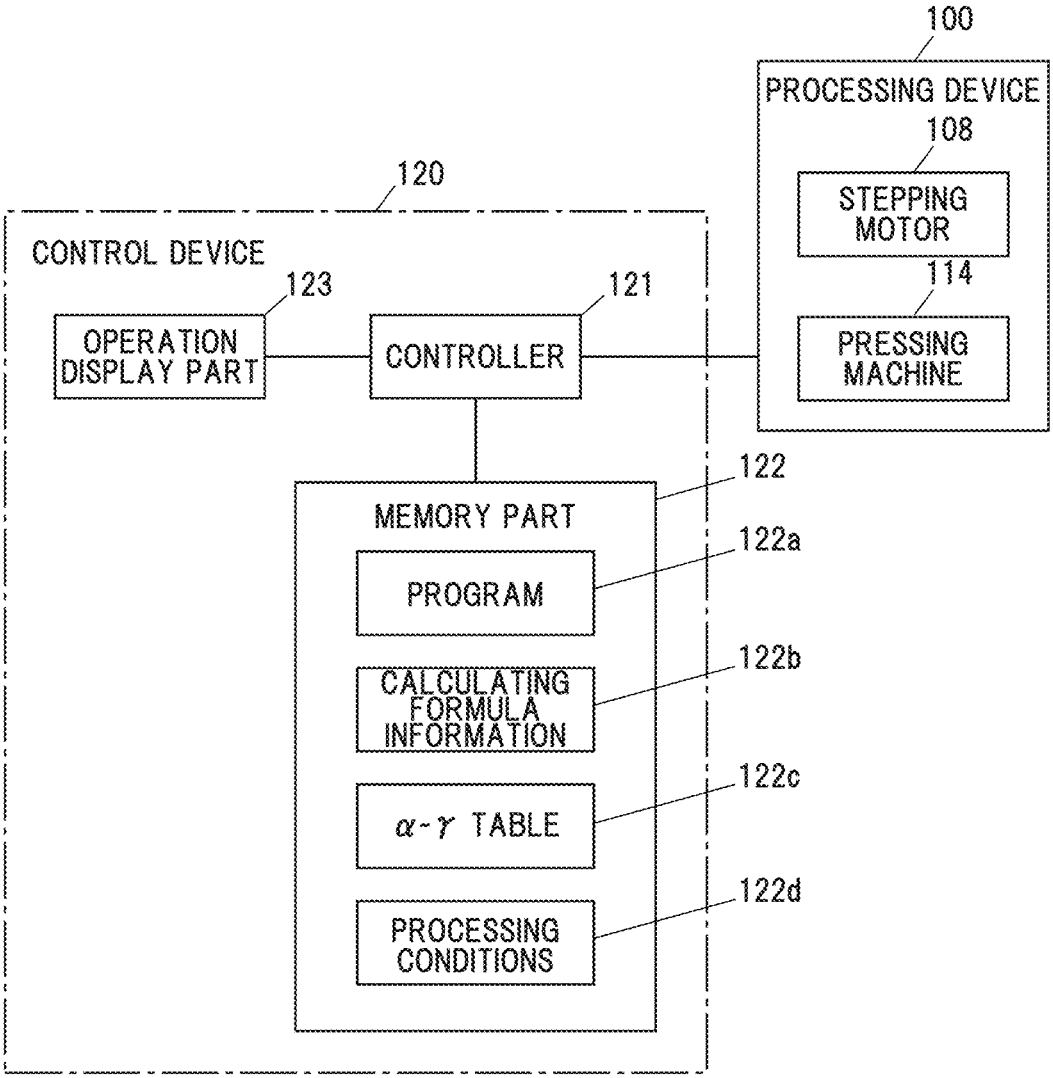
FIG. 10 is a block diagram showing an example of control device.

FIG. 10 is a block diagram showing an example of control device 120. The control device 120 includes a controller 121 including a central processing unit (CPU) and an interface, a read only memory (ROM), a random-access memory (RAM), a memory part 122 including hard disk drive, and an operation display part 123 including touch display.

The memory part 122 memorizes a program 122*a* for processing a method for manufacturing the sheet feed shaft according to the present embodiment, calculating formula information 122*b*, α-γ table 122*c*, processing conditions 122*d* and so on. Herein, the α-γ table 122*c* is an example of relation information showing the relation between the apex angle α and the incident angle γ.

For example, the calculating formula information 122*b* includes the formulas (1), (2), (3), and (4) described as follows. Herein, the formula (1) is an example of relational expression between α and β defined to increase β as α increases.

$$\beta=-0.002\alpha^2+0.854\alpha-3.72 \quad (1)$$

$$\mu2=(1/k)\cdot h\cdot\tan\beta(k\text{: correction factor}) \quad (2)$$

$$\mu3=2h\cdot\tan(\alpha/2) \quad (3)$$

$$\text{Volume of the projection 30}=\text{Volume of the cutting concave part 31} \quad (4)$$

The above formula (1) is an approximate curve of quadratic function calculated by the method of least squares etc., from data of apex angles α and β of the projection 30 included in available range shown in examples 1 to 10 of Table 1 described below. The formula (1) may be a linear curve (line) or a cubic or higher n-th order function.

The above formula (2) is calculated from each length of parts shown in FIGS. 8C and 9 by trigonometric function. The above formula (3) is calculated from each length of parts shown in FIGS. 8B and 9 by trigonometric function.

The above formula (4) is defined based on exposing volume of the cutting concave part 31 outside from the peripherical surface 2*a* and thus forming the projection 30 when forming the cutting concave part 31. The projection 30 and the cutting concave part 31 have shapes approximating a tetrahedron. Volume of the projection 30 can be calculated from μ2, μ3, and h. Since the depth of cutting concave part 31 is proportional to μ3, volume of the cutting concave part 31 can be calculated from μ1, μ3, and depth.

The α-γ table 122*c* memorizes plural combinations of value of apex angle α of the projection 30 and the value of incident angle γ of the perforating edge 52*a* of the perforating unit 50 to the peripherical surface 2*a* of the metallic rod 2. When the apex angle α is defined, the incident angle γ corresponding to the apex angle α can be calculated based on the α-γ table 122*c*, and thus the length L between the perforating members 52A and 52B described below can be defined from the incident angle γ. Therefore, it is possible to form the desirable apex angle α by adjusting the incident angle γ even when the same perforating edge 52*a* is used. In the meantime, the perforating members 52A and 52B that have different tip end angles corresponding to the desired apex angle α may be used. In addition, each calculation is performed by using L/2 when one of the perforating members are used without using one pair of the perforating members 52A and 52B.

Figure 11A:
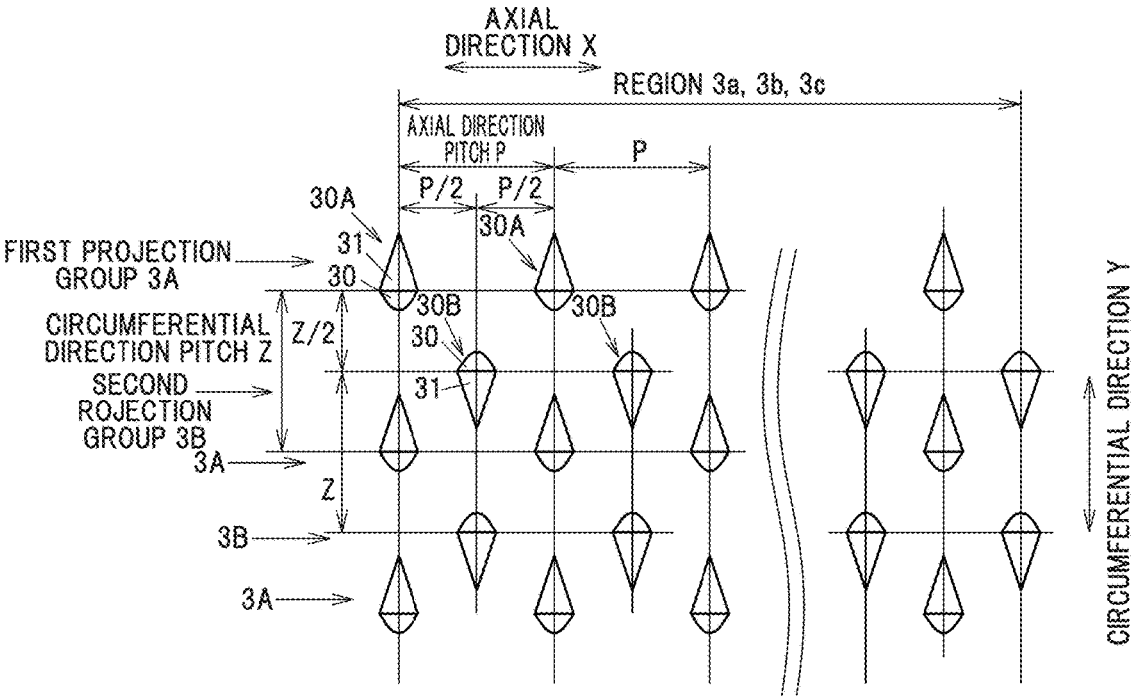
FIGS. 11A and 11B are developed views showing an example of arrangement pattern of projections.

For example, the processing condition 122*d* includes the following conditions:

Condition 1: the length L between the perforating members 52A and 52B satisfies to define the tip ends of adjacent projections 30 viewed form the axial direction X as an equal angle interval θ (as a circumferential direction pitch of Z/2 in FIG. 11A);

Condition 2: the length μ1 of the cutting concave part 31 and the cutting stroke S satisfy the following relation, $$S \approx \mu 1; \text{ and}$$

Condition 3: the length L and an incident angle γ' (adjusted value of incident angle γ) satisfy the following relation, $$L \approx d \cos \gamma'.$$

In the meantime, the conditions are not limited thereof.

(Construction of Controller)

The controller 121 includes a calculation function to calculate L and S of control information to form the projections 30 on the peripherical surface 2*a* of processing target metallic rod 2 by CPU performing the program 122*a*, and a control function to control the processing device 100 based on L and S.

The calculation function included in the controller 121 will be explained below. The controller 121 calculates β from α received from an operation display part 123 by using the formula (1), calculates μ2 from the calculated β by using the formula (2), calculates μ3 from the received α by using the formula (3), calculates μ1 from the calculated μ2 and μ3 by using the formula (4), and calculates the incident angle γ from the received α based on the α-γ table 122*c*. In the meantime, values of α and β by a regular angle (e.g., 1°) based on the formula (1) may be calculated and the α-β table recording the calculated α and β may be memorized in the memory part 122, and then β corresponding to the input α may be obtained from the α-β table. The formula (1) and the α-β table are examples of the relative information between α and β.

When defining the incident angle γ, the length L between the perforating members 52A and 52B. However, since a number of the projections 30 arranged between the length L between the perforating members 52A and 52B (hereinafter, it is referred to as the inside L projection number) from the number of projections 30 viewed from the axial direction X should be integer, the calculated incident angle γ should be adjusted. Thus, the controller 121 determines the incident angle γ' that is the incident angle of which the inside L projection number is integer and is the nearest to the γ firstly calculated so as to satisfy the condition 1 included in the processing condition 122*d*.

The controller 121 calculates L and S of the control information from a number of projections on one row along the determined d, h and the circumferential direction Y (hereinafter, it is referred to as a circumferential projection number) and the calculated μ1, the inside L projection number and the incident angle γ' (the adjusted incident angle γ) to satisfy the conditions 2 and 3 included in the processing condition 122*d*. The circumferential projection number is 12 in case shown in FIG. 4. Here, α is an example of information according to α.

Next, the control function of the processing device 100 included in the controller 121 will be explained. The controller 121 controls the processing device 100 based on the calculated cutting stroke S, plastic works the metallic rod 2 by the perforating edge 52*a* of the perforating unit 50, and forms the projections 30A and 30B having the input α and β corresponding to the concerned α.

Specifically, according to L of the control information, for example, value of L is displayed on the operation display part 123 and the length L between the perforating member 52A and 52B is adjusted by an operator. Further, the controller 121 drives the perforating unit 50 in reciprocate directions opposite to the V-block 102 and controls the cutting stroke S of the perforating unit 50 by controlling the pressing machine 114. Furthermore, the controller 121 controls a forming position of the projection 30 in the circumferential direction by controlling rotation of the stepping motor 108. In the meantime, value of L may be adjusted by controlling a thread member of which a right-handed thread is formed at one side and a left-handed thread is formed at the other side by the controller 121.

(Method for Manufacturing the Sheet Feed Shaft)

Next, an example of method for manufacturing the sheet feed shaft 1 by using a manufacturing device will be explained with referred to FIGS. 11A to 12. First, an arrangement pattern of the projections will be explained with referred to FIGS. 11A and 12.

(Arrangement Pattern of Projections)

Figure 11B:
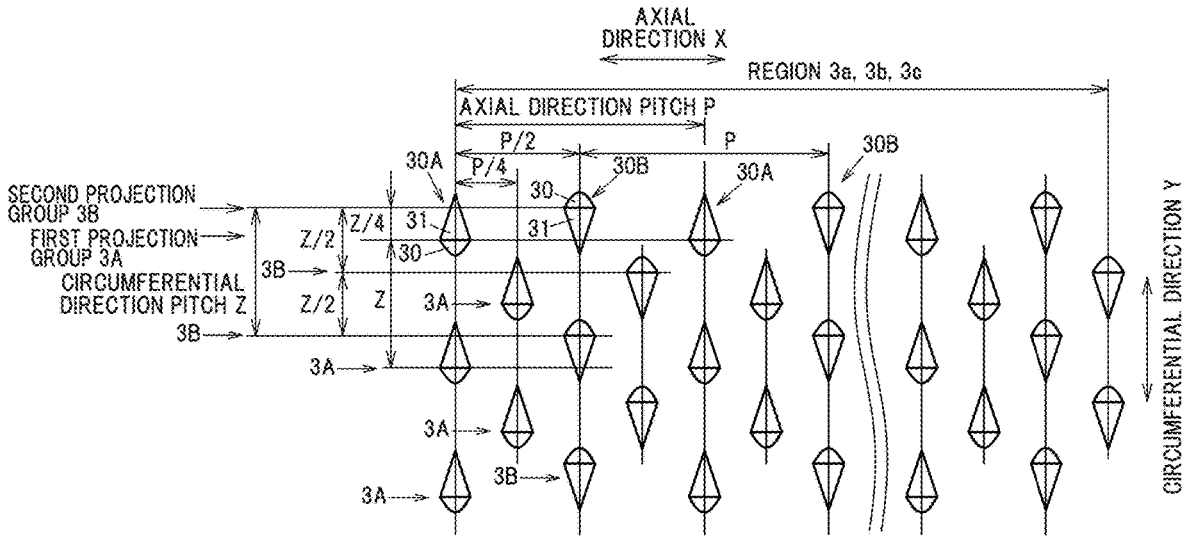

FIGS. 11A and 11B are developed views showing an example of arrangement pattern of projections. FIG. 11A shows an arrangement pattern (hereinafter it is referred to as "alternately arrangement") of the projections explained with FIGS. 2, 4, 6 and so on. FIG. 11B shows an arrangement pattern that respectively staggers the first projection group 3A and the second projection group 3B (hereinafter it is referred to as "alternately staggering arrangement"). In the meantime, an arrangement pattern of projections is not limited thereof.

"Alternately arrangement" shown in FIG. 11A alternately arranges the first projection group 3A and the second projection group 3B for every one row in the axial direction X (the row along the circumferential direction Y) and arranges the second projection group 3B is shifted to the first projection group 3A by a half pitch (Z/2) in the circumferential direction Y.

That is, the first projection group 3A and the second projection group 3B are respectively arranged by pitch Z in the circumferential direction Y, and an interval between the first projection group 3A and the second projection group 3B is arranged by an interval of pitch Z/2 in the circumferential direction Y. In addition, first projection group 3A and the second projection group 3B are respectively arranged by pitch P in the axial direction X, and an interval between the first row of the first projection group 3A and the first row of the second projection group 3B is arranged by pitch P/2 in the axial direction X.

Alternately staggering arrangement shown in FIG. 11B is an arrangement that alternately arranges the first projection group 3A and the second projection group 3B by two rows (along the circumferential direction) in the axial direction X. and arranges the two row second projection groups 3B to shift the two row first projection groups 3A by ¼ of pitch in the circumferential direction Y That is, the first row and the next row of the first projection groups 3A and the first row and the next row of the second projection group 3B are respectively arranged by the pitch Z in the circumferential direction Y, the next row is arranged to shift from the first row by a half pitch (Z/2) in the circumferential direction Y, and the first row of the first projection group 3A and the first row of the second projection group 3B are arranged with having an interval of pitch Z/4 in the circumferential direction Y. Further, each row of the first projection group 3A and the second projection group 3B (rows along the circumferential direction) are respectively arranged by pitch P in the axial direction X. Furthermore, the first projection group 3A and the second projection group 3B are arranged to have an interval of pitch P/4 in the axial direction X between the first row and the second row of those. In addition, the first row of the first projection group 3A and the first row of the second projection group 3B are arranged to have an interval of pitch P/2 in the axial direction X. By setting the arrangement of the projections 30 as the alternately staggering arrangement, it is possible to increase density of the projections 30 more than the alternately arrangement. The alternately staggering arrangement can be formed by forming the first projection group 3A and the second projection group 3B for each row (row along the circumferential direction Y) in the axial direction X, after perforating all around the metallic rod 2 for the second projection group 3B w % bile being shifted to the first projection group 3A by ¼ pitch (Z/4) in the circumferential direction Y, shifting the metallic rod 2 relatively by ¼ pitch (P/4) in the axis direction shifting X and by ½ pitch (Z/2) in the circumferential direction Y, perforating all around the metallic rod 2 in the same manner as the previous time.

(1) Calculating L and S of the Control Information

Figure 12:
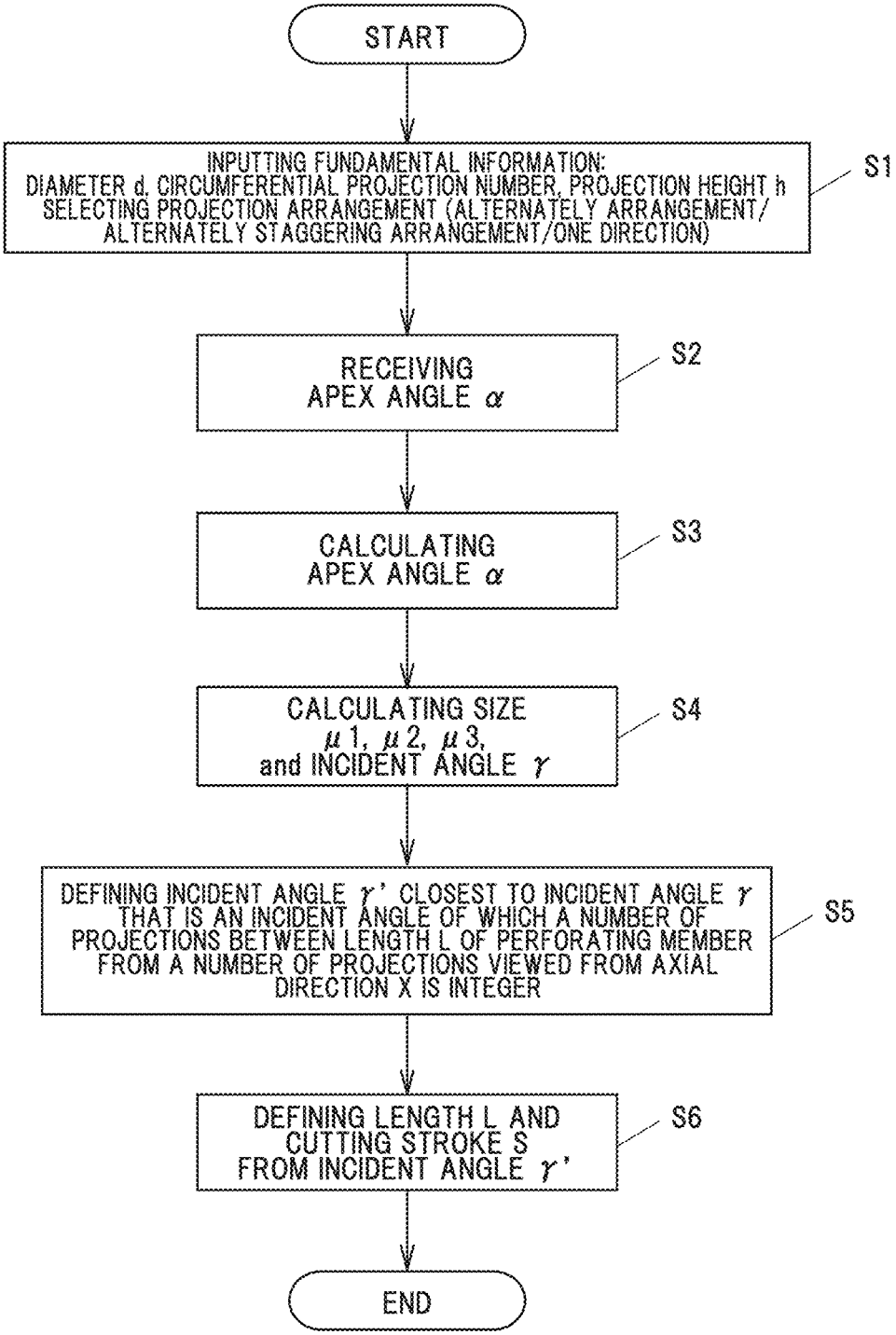
FIG. 12 is a flow chart showing an example of control of a control device for calculating L and S.

FIG. 12 is a flow chart showing an example of performance of the control device 120 for calculating L and S of the control information.

First, an operator inputs a diameter d of the metallic rod 2, the circumferential projection number, and a projection height h as a fundamental information in the operation display part 123, and then selects the arrangement of the projections 30 from alternately arrangement, alternately staggering arrangement/one direction (only one of the projections 30A and 30B) (Step S1). Herein, the alternately arrangement will be selected. In the meantime, all or part of the diameter d, the projection height h, the circumferential projection number, and the arrangement of the projections 30 may be predetermined.

Next, an operator inputs the apex angle α of the projection 30 in the operation display part 123, and then the controller 121 receives the apex angle α of the projection 30 (Step S2).

Next, the controller 121 calculates the apex angle β form the apex angle α received in step S2 by using the formula (1) (Step S3), and calculate each part size μ1, μ2, μ3, and the incident angle γ (Step S4). That is, the controller 121 calculates μ2 from the calculated β by using the above formula (2), calculates μ3 from the calculated α by using the above formula (3), calculates μ1 from the calculated μ2 and μ3 by using the formula (4), and calculates the incident angle γ from the received α based on the α-γ table 122*c*.

The controller 121 determines the incident angle γ' which is the incident angle of which the inside L projection number is integer and is the nearest to the γ firstly calculated so as to satisfy the condition 1 included in the processing condition 122*d* (Step S5). For example, in the case shown in FIG. 4, the arrangement pattern of the projections is alternately arrangement shown in FIG. 11A. The circumferential projection number is 12. A number of the projections 30 that can be viewed from the axial direction X is 24. The interval angle θ shown in FIG. 4 (the circumferential direction pitch Z/2) is 15°. In the meantime, when the alternately staggering arrangement shown in FIG. 11B is selected as the arrangement pattern of the projection, a number of the projections 30 that can be viewed from the axial direction X is 48, and the interval angle θ (circumferential direction pitch Z/4) is 7.5° even though the circumferential projection number is the same twelve.

Next, the controller 121 calculates values of L and S of the control information from the determined d, h and the circumferential projection number, and the calculated μ1, the inside L projection number and incident angle γ' so as to satisfy the conditions 2 and 3 included in the processing condition 122*d* and then displays values of L and S on the operation display part 123 (Step S6).

(2) Processing Based on L and S of the Control Information

An operator adjusts the length L between the perforating members 52A and 52B to the value of L displayed on the operation display part 123 and arranges the metallic rod 2 on the v-block 102 when the perforating unit 50 is risen at top dead point.

Next, the controller 121 rotates the stepping motor 108 and determine a processing position of the metallic rod 2, lowers the perforating unit 50 from the top dead point by controlling the pressing machine 114, and then perforating edges 52*a* of each of the perforating members 52A and 52B are cut into the peripherical surface 2*a* of the metallic rod 2 by controlling the cutting stroke S of the perforating unit 50. The projections 30A and 30B are formed in an opposite direction each other by cutting.

Next, the controller 121 raise the perforating unit 50 to the top dead point by the pressing machine 114 after forming each one row of the projections 30A and 30B. Then, the controller 121 rotates a driving gear 109 by a constant angle by the steeping motor 108, similarly rotates a layout gear 107 geared up to the driving gear 109, and thus changes a rotational support position of the metallic rod 2.

Next, after determining the rotational position of the metallic rod 2, the controller 121 lowers the perforating unit 50 and cut into by the perforating members 52A and 52B, and forms similar projections 30A and 3B at adjacent rows of each row of the projections 30A and 30B formed before. By repeating, the plural first projection groups 3A and the second projection groups 3B are formed at one region 3*a* of the metallic rod 2. Thus, the sheet feed shaft 1 shown in FIGS. 1 and 2 is manufactured by moving the metallic rod 2 in the axial direction, forming the projections 30A and 30B as described above, and forming the plural first projection groups 3A and the second projection groups 3B on the other two regions 3*b* and 3*c*.

(Effects of the Present Embodiment)

According to the present embodiment, it has the effect described as follows.

(a) It is possible to decrease the feeding unevenness of sheets since it is possible to form the projection 30 having the apex angles α and β within the preferable range corresponding to the characteristics of the sheet 12. In addition, it is possible to form the projection 30 that has good resistance and prevents damage for the sheet 12.

(b) It is possible to stably form the most suitable projection without demanding on operator's experience and intuition since the preferable apex angle β corresponding to the apex angle α of the projection 30 can be calculated by the control device 120.

(Variation 1)

FIG. 13 is a table showing an example of α-β table in the variation 1. The memory part 122 may further memorize the α-β table 122*e*. The α-β table 122*e* includes items of "division of projection," "level," "α," "β," "μ1," "μ2," and "μ3."

In "division of projection," large projection indicating that α is relatively large, middle projection indicating that α is relatively middle, small projection indicating that α is relatively small are memorized. In the "level," +4, +3, +2, +1, 0, −1, −2, −3, −4, −5 displaying value of α by step are memorized. The level increases corresponding to the index (e.g., hardness) indicating resistance to bite by the projection 30 of the sheet 12. Although a region having middle a is indicated as "+1, 0, −1, −2" in the level, the level is suitably selected corresponding to difference such as hardness even when the sheet 12 is formed of the same material. For example, in the case of a sheet material as type 2 sheet such as polyethylene film, −1 or −2 in the level is selected corresponding to a degree of hardness for a hard-type sheet material, and +1 or 0 in the level is selected corresponding to a degree of hardness for a soft-type sheet material. For example, as α=85° is selected, β, μ1, μ2, and μ3 corresponding to α=850 are calculated. And then γ and L are calculated as μ1=S. The calculated value S and L are corrected such that a projection number is an integer.

In "α," α is memorized by a unit of angle. In "β," preferable β corresponding to α is memorized by a unit of angle. In "μ1," "μ2," and "μ3" μ1, μ2, and μ3 shown in FIGS. 8B, 8C, 9 are respectively memorized by a unit of millimeter.

Each value of α, β, μ1, μ2, μ3 corresponds to the examples 1 to 10 described below. Herein, large projection, middle projection, small projection are examples of value information indicating the value of α by step. In the meantime, although the α-β table 122*e* indicates the case that the height h of the projection 30 is 0.07 mm, the α-β table 122*e* may be provided by each different h. In addition, the α-β table 122*e* may include L and S.

In the above embodiment, although the controller 121 receives any α, the controller 121 may display list of α shown in FIG. 13 on the operation display part 123 and α may be selected by an operator. In this case, the controller 121 obtains β, μ1, μ2, μ3 from the α-β table 122*e* without using the formulas (1) to (4). As others are the same with the above embodiment, L and S are calculated from d, h, circumferential projection number, μ1, the inside L projection number and γ' so as to satisfy the processing condition 122*d*.

In addition, an operator may select level shown in FIG. 13 (+4 to −5) displayed on the operational display part 123 instead of selecting α, and may select division of projection displayed on the operation display part 123 shown in FIG. 13. In this case, an operator may select level that is a median of the selected division of projection. For example, when the small projection is selected, it may be regarded as selecting level +2 or +3, when the middle projection is selected, it is regarded as selecting level −4, and when the large projection is selected, it is regarded as selecting level −4. In addition, the sheet type of processed sheet 12 (type 1 sheet, type 2 sheet or type 3 sheet) may be selected instead of the division of projection.

EXAMPLES

Next, examples according to the present invention will be explained with referred to FIGS. 14A to 15 and Table 1.

Figure 14A:
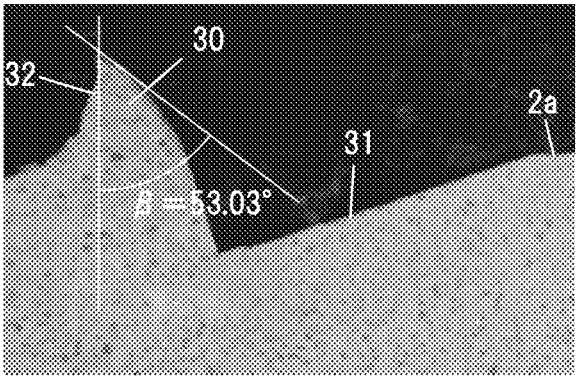
FIG. 14A is a photograph showing a longitudinal cross-section around the projection of the example 5.
Figure 14B:
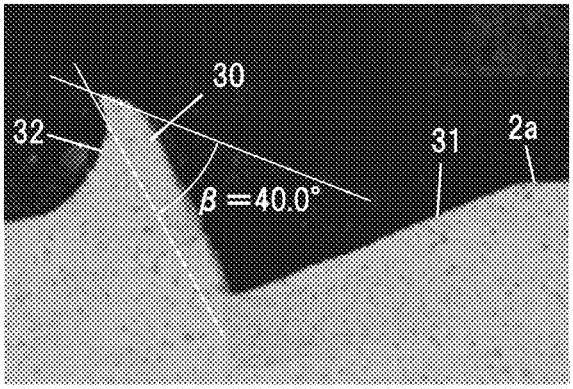
FIG. 14B is a photograph showing a longitudinal cross-section around the projection of the comparative example 1.

FIG. 14A is a photograph showing a longitudinal cross-section around the projection of the example 5. FIG. 14B is a photograph showing a longitudinal cross-section around the projection of the comparative example 1. FIG. 14A shows a photograph of the example 5 having h=70 μm, α=81.9°, β=53.03°. FIG. 14B shows a photograph of comparative example 1, which shows the same h and α with the example 5. Meanwhile, β of FIG. 15B is 40.0° smaller than that of example 5. Therefore, the example 5 is within the available range. In the meantime, the comparative example 1 is out of the available range.

TABLE 1

| Examples | μ1 | μ2 | μ3 | α | β | Feeding unevenness |
|---|---|---|---|---|---|---|
| Example 1 | 0.198 | 0.145 | 0.186 | 106.1 | 64.23 | not more than 10 μm |
| Example 2 | 0.192 | 0.133 | 0.169 | 100.7 | 62.24 | " |
| Example 3 | 0.187 | 0.120 | 0.154 | 95.5 | 59.74 | " |
| Example 4 | 0.183 | 0.106 | 0.137 | 88.8 | 56.56 | " |
| Example 5 | 0.178 | 0.093 | 0.122 | 81.9 | 53.03 | " |
| Example 6 | 0.173 | 0.078 | 0.104 | 73.2 | 48.09 | " |
| Example 7 | 0.169 | 0.065 | 0.087 | 64.0 | 42.88 | " |
| Example 8 | 0.164 | 0.051 | 0.071 | 53.8 | 36.08 | " |
| Example 9 | 0.161 | 0.039 | 0.055 | 42.9 | 29.12 | " |
| Example 10 | 0.155 | 0.026 | 0.038 | 30.7 | 20.66 | " |

Table 1 memorize values corresponding to the examples 1 to 10 within the available range extracted from the experimental result described above according to the plural combinations of α and β when the diameter d of the metallic rod 2 is 12 mm, the height h of the projection 30 is 0.07 mm. Values of μ1, μ2, μ3 in Table 1 are actually measured values. α in Table 1 is a value calculated from μ3 and h by using the following formula (5). β in Table 1 is a value calculated from μ1 and h by using the following formula (6).

$$\alpha=2\times\tan^{-1}(\mu3/2h) \tag{5}$$

$$\beta=k\cdot\tan^{-1}(\mu2/h) \tag{6}$$

k shown in the formula (6) is a correction factor to correspond some values of β actually measured and is defined as 1.12 in this example. In the above formula (5), since the calculated value of α in the formula (5) approximately corresponds to value of α actually measured, a correction factor is not used. However, the correction factor may be used such that the measured value is close to the actually measured value.

Figure 15:
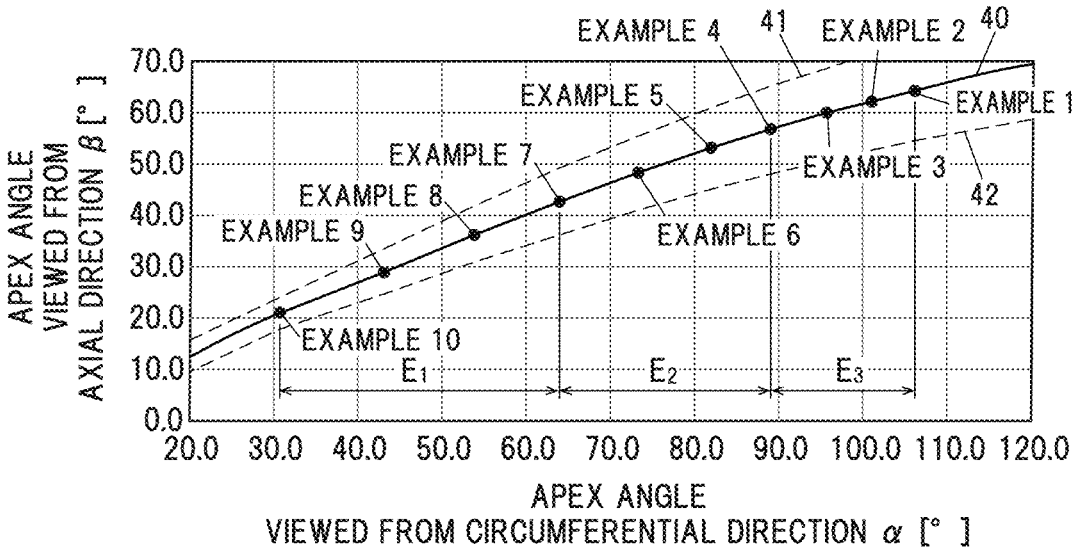
FIG. 15 is a graph showing preferable combinations of a and D in the examples.

FIG. 15 is a graph showing a preferable combination of α and β in the examples. It is preferable to set the range of α is not less than 30° and not more than 110°, divide the range of α corresponding to the characteristics of the sheet used into, for example, the first range $E_1$ of 30°≤α≤64°, the second range $E_2$ of 64°≤α≤89°, and the third range $E_3$ of 89°<α=110°, and use the type 1 sheet in the first range $E_1$, use the type 2 sheet in the second range $E_2$, and the type 3 sheet in the third range $E_3$.

As shown in FIG. 15, a base line 40 approximated from the examples 1 to 10 can be defined by the above formula (a). In addition, a maximum line 41 can be defined by $\beta=\beta_0\times1.15$, a minimum line 42 can be defined by $\beta=\beta_0\times0.85$. The region between the maximum line 41 and the minimum line 42 is a region where the combination of a and 0 is within the available range. In the meantime, base lines approximated by straight line at plural ranges where α is different may be used as the base line 40.

Although the embodiment of the invention has been described, the invention according to claims is not to be limited to the embodiment described above. The invention can be appropriately modified and implemented. In addition, steps may be added, deleted, changed, or exchanged.

REFERENCE SIGNS LIST

1 Sheet Feed Shaft
2 Metallic Rod
2*a* Peripherical Surface
3A First Projection Group
3B Second Projection Group
3*a* to 3*c* Region
10 Sheet Feed Device
11 Feed Roller
12 Sheet
12*a* Print Surface
12*b* Back Surface
30, 30A, 30B Projection
30*a* Cutting Surface
30*b* Rising Surface
31 Cutting Concave Part
40 Base Line
41 Maximum Line
42 Minimum Line
50 Perforating Unit
51 Holding Member
52A, 52B Perforating Member
52*a* Perforating Edge
53 Fastener
100 Processing Device
101 Base
102 V-Block
103 Lifter
106 Holding Bush
107 Layout Gear
108 Stepping Motor
109 Driving Gear
114 Pressing Machine
120 Control Device
121 Controller
122 Memory Part
122*a* Program
122*b* Calculating Formula Information
122*c* α-γ Table
122*d* Processing Conditions
122*e* α-β Table
123 Operation Display Part
C Center
CL Center Line
d Diameter
h Height
L Length
P Pressure
S Cutting Stroke
X Axial Direction
α Apex Angle of Projection Viewed from Circumferential Direction of Metallic Rod
β Apex Angle of Projection Viewed from Axial Direction of Metallic Rod
γ Incident Angle
Y Circumferential Direction
θ Angle

The invention claimed is:

1. A sheet feed shaft, comprising:

a metallic rod; and a plurality of projections formed by plastic working to rise in a circumferential direction at a plurality of regions in the circumferential direction and in an axial direction on a peripherical surface of the metallic rod, wherein α and β satisfy following relations (a) and (b) in a range that the α is not less than 300 and not more than 110°, $$\beta_0=-0.002\alpha^2+0.854\alpha-3.72, \quad (a)$$

$$0.85\times\beta_0\leq\beta\leq1.15\beta_0, \quad (b)$$

where an apex angle of the projections viewed from the circumferential direction of the metallic rod is defined as α, and an apex angle of the projections viewed from an axial direction of the metallic rod is defined as β.

* * * * *